US006640394B1

(12) United States Patent
Berrocal et al.

(10) Patent No.: US 6,640,394 B1
(45) Date of Patent: Nov. 4, 2003

(54) TAMPER-PROOF TIE

(75) Inventors: William G. Berrocal, Worcester, MA (US); James C. Benoit, Needham, MA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 10/121,022

(22) Filed: Apr. 11, 2002

(51) Int. Cl.[7] ..... B65D 63/16; F16B 2/08

(52) U.S. Cl. ..... 24/16 PB; 24/17 B; 24/17 AP; 24/30.5 P; 292/318; 292/321; 292/322

(58) Field of Search ..... 24/16 PB, 17 AP, 24/17 B, 30.5 P; 292/317, 318, 319, 321, 322, 307 R, 307 B; 70/58

(56) References Cited

U.S. PATENT DOCUMENTS

| | | | | | |
|---|---|---|---|---|---|
| 2,979,794 | A | * | 4/1961 | Bartolo | 24/17 AP |
| 3,556,575 | A | | 1/1971 | Farkas | |
| 3,712,655 | A | | 1/1973 | Fuehrer | |
| 3,766,608 | A | | 10/1973 | Fay | |
| 3,816,879 | A | | 6/1974 | Merser et al. | |
| 3,881,759 | A | * | 5/1975 | Fuehrer | 292/321 |
| 3,954,294 | A | * | 5/1976 | Iwamoto et al. | 292/318 |
| 4,003,106 | A | | 1/1977 | Schumacher et al. | |
| 4,059,300 | A | * | 11/1977 | Moberg et al. | 24/16 PB |
| 4,240,183 | A | | 12/1980 | Sumimoto et al. | |
| 4,248,462 | A | * | 2/1981 | Choi | 292/322 |
| 4,299,417 | A | * | 11/1981 | McClure | 24/16 PB |
| 4,347,648 | A | | 9/1982 | Dekkers | |
| 4,688,302 | A | | 8/1987 | Caveney et al. | |
| 4,754,529 | A | | 7/1988 | Paradis | |
| 4,946,210 | A | * | 8/1990 | Fuehrer | 292/321 |
| 5,224,244 | A | * | 7/1993 | Ikeda et al. | 24/16 PB |
| 5,364,141 | A | * | 11/1994 | King | 292/318 |
| 5,636,412 | A | | 6/1997 | Lodi et al. | |
| 5,685,048 | A | | 11/1997 | Benoit | |
| 6,105,210 | A | | 8/2000 | Benoit | |

FOREIGN PATENT DOCUMENTS

| | | | | |
|---|---|---|---|---|
| GB | 2058194 | | 8/1980 | |
| GB | 2145150 | * | 3/1985 | 24/16 PB |

OTHER PUBLICATIONS

Brochure, Catamount Manufacturing Incorporated, Restricted Bundle Cable Tie, p. 7; No date is given.

* cited by examiner

*Primary Examiner*—Victor Sakran
(74) *Attorney, Agent, or Firm*—Kriegsman & Kriegsman

(57) ABSTRACT

A tamper-proof tie includes a head and an attached strap. The head includes a strap accepting channel and a blind cavity. The strap accepting channel includes a strap entry end and a strap exit end. The blind cavity includes an open end. The head includes a flexible locking member comprising first and second ends which are fixed in place within the head. The strap includes an anti-tampering device which comprises a finger and a projection. In use, the strap is inserted into the strap accepting channel so the tie forms a closed loop. As the strap is inserted into the head, the locking member engages the anti-tampering device to prevent withdrawal of the strap from the head. With the tie formed into a closed loop, the anti-tampering device substantially encloses the entry end and the exit end of the strap accepting channel and the open end of the blind cavity.

19 Claims, 9 Drawing Sheets

TAMPER-PROOF TIE

BACKGROUND OF THE INVENTION

The present invention relates generally to ties and, more particularly, to ties which can be formed into a closed loop.

Ties are well known in the art and are widely used in a variety of different applications.

One tie which is well known and widely used in the art is the cable tie. Cable ties are widely used in the art for bundling together of a plurality of objects, such as a group of wires.

One well known cable tie which is commonly used in commerce comprises a serrated strap which is fitted to an apertured head. In use, the cable tie can be formed into closed loop by inserting the serrated strap through the apertured head. With the serrated strap inserted through the apertured head, an internal pawl, or locking tang, disposed within the apertured head lockably engages the serrations of the strap to prevent the strap from being backed out of the apertured head. In this manner, the engagement of the internal pawl onto the serrated strap secures the cable tie in its closed loop configuration.

Another well known cable tie which is commonly used in commerce comprises an apertured, or ladder-type, strap which is fitted to a buckle-like head. In use, the cable tie can be formed into a closed loop by inserting the ladder-type strap through the buckle-like head. With the ladder strap inserted through the buckle head, a tongue, or internal pawl, disposed within the buckle head lockably engages the apertures of the strap to prevent the strap from being backed out of the head. In this manner, the engagement of the tongue into the apertures of the strap secures the cable tie in its closed loop configuration.

In U.S. Pat. No. 3,766,608 to Fay, which is incorporated herein by reference, there is disclosed a cable tie formed by a locking head and an attached ladder strap. The head contains a longitudinal guide channel for receiving the strap, after encirclement of items to be bundled, and an internal locking tang. The latter is deflected with respect to relatively narrow auxiliary channels on opposite sides of the guide channel. One of the auxiliary channels receives the locking tang during the bundling of the items; the other auxiliary channel contains a stop against which the locking tang becomes abutted in planar engagement by the reverse thrust of the harnessed items.

In U.S. Pat. No. 4,347,648 to Dekkers, which is incorporated herein by reference, there is disclosed a cable tie formed by a locking head and an attached ladder strap. The head contains a locking tang and a guide channel that receives the strap after encirclement of items to be bundled. The tang engages the rungs of the ladder strap for the adjustable retention of the items. The free end of the strap has a light-weight webbed tail that facilitates the insertion of the strap into the head. The strap is advantageously molded of a stretch reorientable material and is subsequently stretched to produce a suitable strengthening and elongation of the webbed tail.

Another tie which is well known and widely used in the art is the fixed-loop tie.

One well known fixed-loop tie which is commonly used in commerce comprises a strap, or fastener, which is fitted to a head. In use, the fixed-loop tie can be formed into a closed loop by inserting the strap into the head. The head is provided with an internal pawl or flange which lockably engages the strap to prevent the strap from being backed out of the head, thereby securing the tie in its closed loop configuration.

Fixed-loop ties differ from traditional cable ties in that fixed-loop ties are constructed in such a manner that the tie can only be formed into a limited range of closed loop sizes. In particular, the strap of a fixed-loop tie is commonly provided with an enlarged stop which limits the degree of advancement which the strap can be inserted into the head, thereby creating a minimum size closed loop into which the tie can be formed during use.

Fixed-loop ties are commonly used in a plurality of different applications.

As an example, fixed-loop ties are commonly used in the art to couple together two or more objects, fixed-loop ties which are utilized in this manner being commonly identified as merchandise pairing ties in the art. Merchandise pairing ties are commonly used in the art to couple together a pair of shoes. In this capacity, merchandise pairing ties have been found to be not only a very useful device in displaying the pair of shoes for sale but also an effective device for preventing the theft of a single shoe, which is a common transgression.

To use a fixed-loop tie of the type described above to pair together a pair of shoes, the tail end of the strap is inserted through an eyelet or under the shoelace of each shoe. The tail is then inserted through a guide channel formed in the head so that the tie forms a closed loop. As the strap is further drawn forward through the guide channel of the head, the closed loop decreases in size. However, it should be noted that, increased insertion of the strap through the head will eventually cause the stop formed on the strap to abut against the head, thereby preventing further insertion of the strap into the head and limiting the size of the closed loop formed by the tie. As can be appreciated, because such a merchandise pairing tie has a substantially large minimum closed loop size, the shoes are ensured a substantial degree of separation which enables a prospective buyer the opportunity to comfortably try on and walk around in the shoes, which is highly desirable.

In U.S. Pat. No. 6,105,210 to J. C. Benoit, which issued on Aug. 22, 2000 and which is incorporated herein by reference, there is disclosed a merchandise pairing tie for use in pairing together two objects. The tie comprises a head having an elongated channel extending therethrough, a locking tang within the head, and a strap having a length of approximately 63.3 cm. The strap comprises a first end integrally formed onto the head and a second end. A projection is formed on the strap between the first end and the second end. The portion of the strap from the projection to the first end is in the form of an elongated, flexible filament having a length of approximately 59.5 cm. The elongated filament is narrow in thickness, narrow in width and has a generally uniform, rectangularly-shaped cross-section. In one embodiment, the portion of the strap from the projection to the second end is formed in a ladder structure having a plurality of rungs. The rungs of the strap are sequentially engaged by the locking tang when the strap is inserted into and through the elongated channel to form a closed loop. As the strap is further inserted through the elongated channel, the size of the closed loop is decreased. The projection serves as a stop to limit the minimum size of the closed loop which can be formed when the strap is inserted into the head.

As another example, fixed-loop ties are also commonly used in the art to secure a ticket, or tag, onto an article of clothing. In particular, fixed-loop ties of this type are often used to secure a ski ticket, or pass, onto the jacket of a consumer. As such, the fixed-loop tie acts as a security device for preventing an unscrupulous consumer from removing the ski ticket from his/her jacket in order to enable another person to share in the use of the same ticket.

As another example, fixed-loop ties are also commonly used in the art to secure the cover, or lid, of a box, or other similar container, in a closed position. In particular, fixed-loop ties of this type are often used to secure the cover of a tote box or other similar container for holding high-cost items, such as pharmaceuticals, electronics or food supplies, in a closed position during shipping. As such, the closed-loop tie acts as security device for preventing the theft of the items held within the container.

As another example, fixed-loop ties are also commonly used in the art as security seals. Specifically, security seals are commonly used to retain an item in its closed position. It should be noted that security seals often include a unique identifier, such as a bar code or unique identification number. Accordingly, the unique identifier allows the owner of the item to determine whether the primary seal has been severed and then replaced with a secondary seal which is similar in appearance to the primary seal. As can be appreciated, security seals are commonly used to secure the back door of a truck, this type of security seal being commonly referred to as a truck seal in the art.

Although well known and widely used in commerce, cable ties and fixed-loop ties of the type described above suffer from a notable drawback. Specifically, it has been found that ties of the type described above are susceptible to tampering. In fact, it has been found that, on occasion, unscrupulous consumers have been able to tamper with the locking tang in the head of the tie so as to disengage the locking tang from the strap, thereby enabling the consumer to back the strap out from the head and open the closed loop formed by the tie. As can be appreciated, when such a tie is used in a security application, such as to secure the lid of a pharmaceutical tote box in a closed position during shipping, the ability of an unscrupulous consumer to tamper with the tie can result in theft, which is highly undesirable.

SUMMARY OF THE INVENTION

It is an object of the present invention to provide a new and improved tie.

It is another object of the present invention to provide a tie of the type comprising a locking head and an attached strap, wherein the tie can be formed into a closed loop by inserting the strap into the locking head.

It is yet another object of the present invention to provide a tie of the type described above wherein the locking head includes a locking member which, with the strap inserted into the locking head, engages the strap to secure the tie in its closed loop configuration.

It is still another object of the present invention to provide a tie as described above which is constructed to prevent tampering of the locking member when the tie is formed in its closed loop configuration.

It is another object of the present invention to provide a tie as described above which limits the minimum size of the closed loop which can be formed when the strap is inserted into the head.

It is another object of the present invention to provide a tie as described above which can be constructed from a single molded piece.

It is yet another object of the present invention to provide a tie as described above which is inexpensive to manufacture and easy to use.

Accordingly, there is provided a tie comprising a head shaped to include an elongated strap accepting channel, the strap accepting channel having a longitudinal axis, a strap entry end and a strap exit end, said head comprising a locking member which is disposed to project into the strap accepting channel, the locking member comprising a first end and a second end, the first and second ends of the locking member being fixed in place within said head, and a strap having a first end and a second end, the first end being formed onto said head, said strap being sized and shaped to be inserted into the strap accepting channel so said tie forms a closed loop, said strap being adapted to be engaged by said locking member when said tie is formed into a closed loop.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate an embodiment of the present invention and, together with the description, serve to explain the principles of the invention. In the drawings, wherein like reference numerals represent like parts.

DETAILED DESCRIPTION OF A PREFERRED EMBODIMENT

Figure 1:
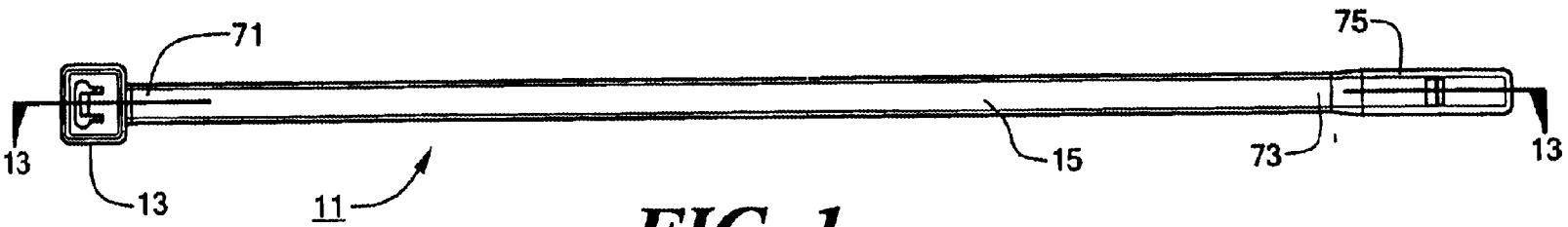
FIG. 1 is a top plan view of a first embodiment of a tie constructed according to the teachings of the present invention.
Figure 2:
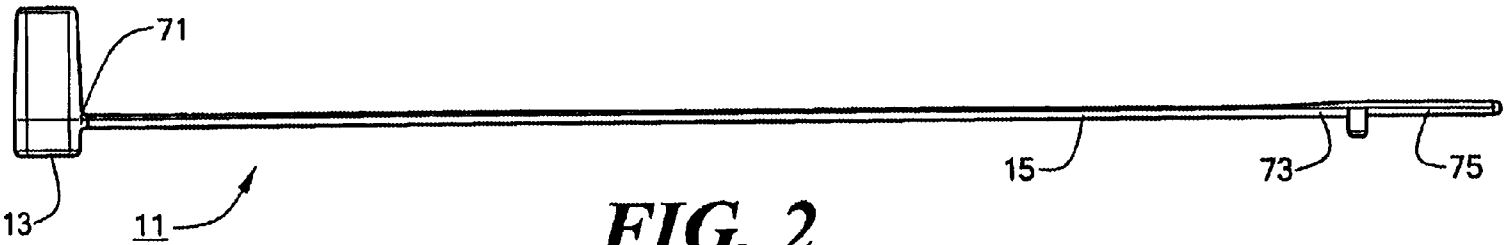
FIG. 2 is a front plan view of the tie shown in FIG. 1.
Figure 3:
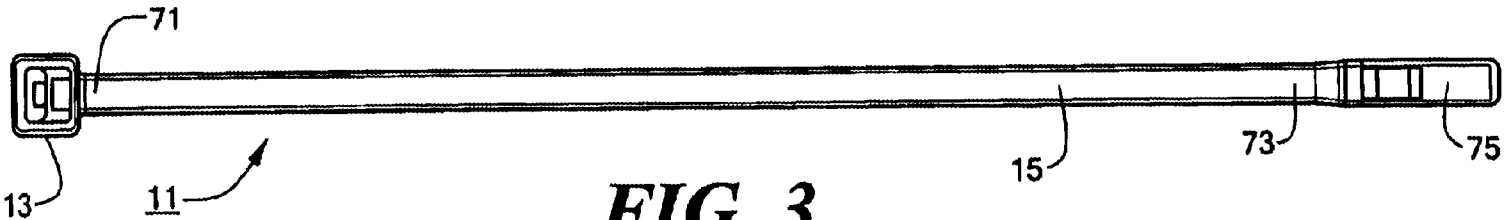
FIG. 3 is a bottom plan view of the tie shown in FIG. 1.
Figure 4:
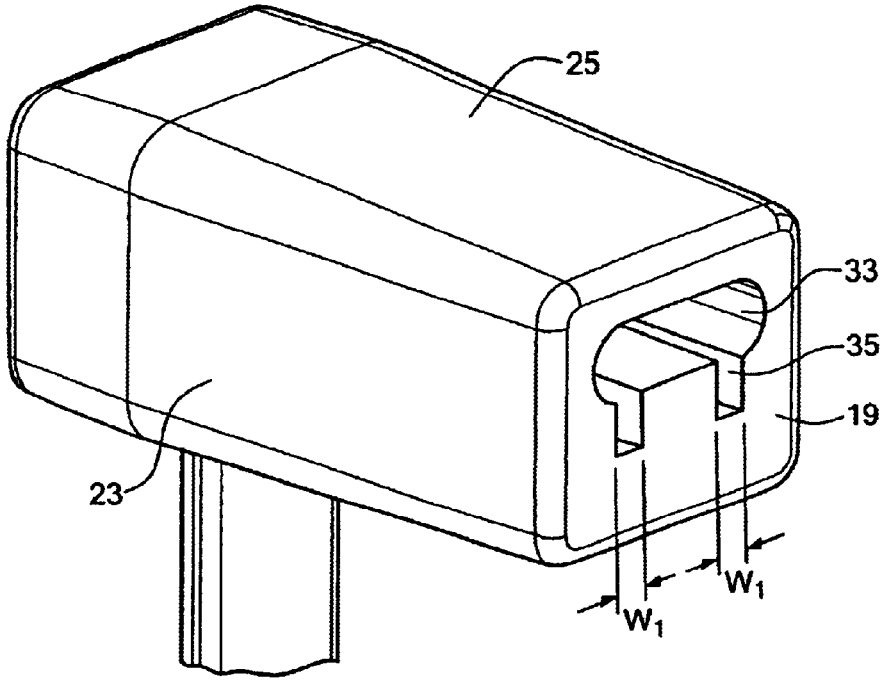
FIG. 4 is an enlarged, fragmentary, top perspective view of the head of the tie shown in FIG. 1.
Figure 5:
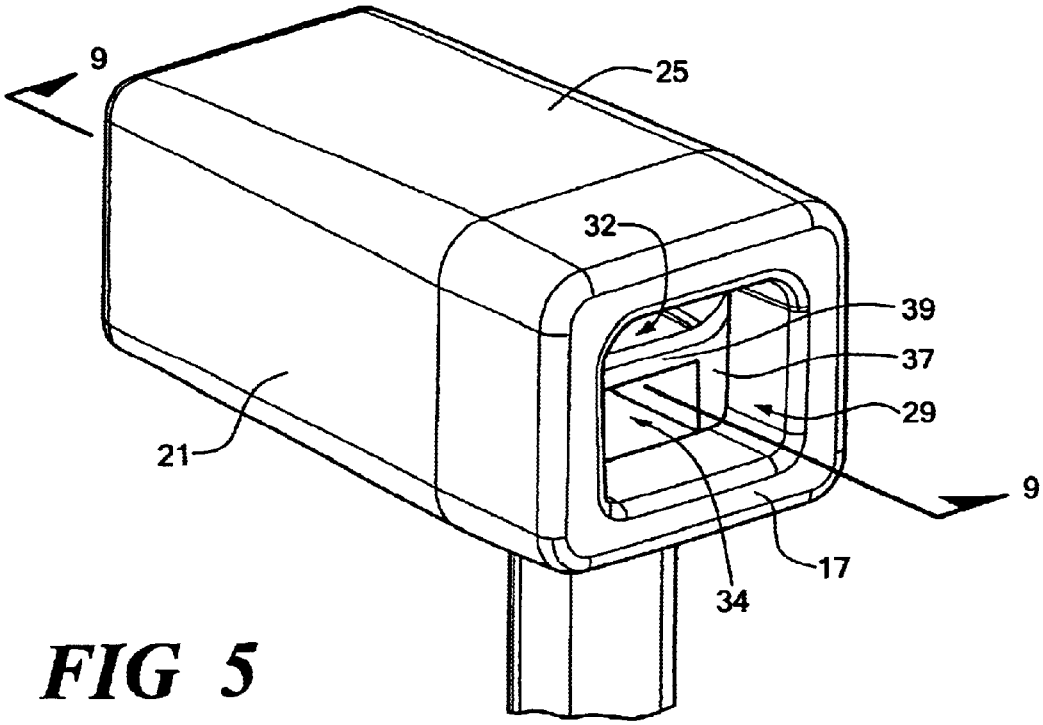
FIG. 5 is an enlarged, fragmentary, bottom perspective view of the head of the tie shown in FIG. 3.
Figure 6:
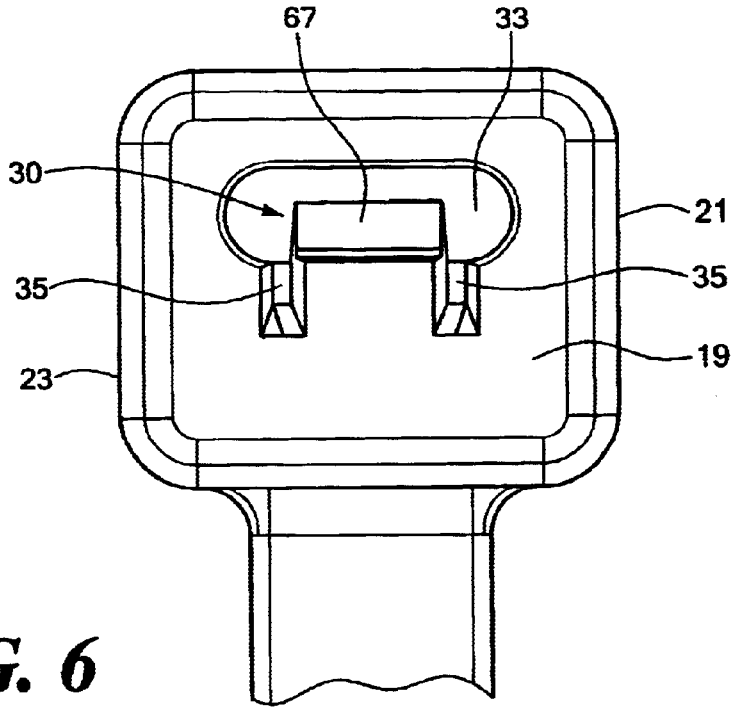
FIG. 6 is an enlarged, fragmentary, top plan view of the head of the tie shown in FIG. 1.
Figure 7:
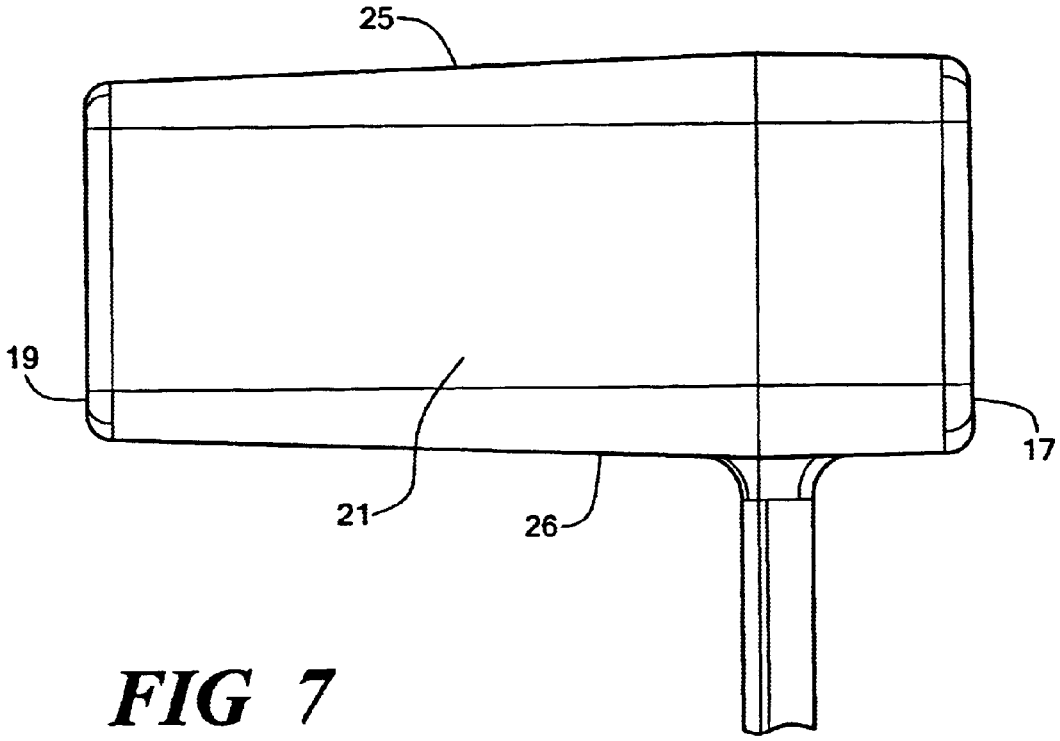
FIG. 7 is an enlarged, fragmentary, rear plan view of the head of the tie shown in FIG. 2.

Referring now to the drawings, there is provided a tie constructed according to the teachings of the present invention, the tie being identified generally as reference numeral 11. As will be described further in detail below, the particular construction of tie 11 renders it unsusceptible to tampering when formed into a closed loop, which is highly desirable.

Tie 11 is designed principally for use in securely fastening a ski tag onto an article of clothing, such as a ski jacket. However, it is to be understood that tie 11 is not limited to a ski tag fastening application. Rather, it is to be understood that tie 11 could be used in any application which requires a tie that can be formed into a fixed-sized closed loop. As an example, tie 11 could be used to secure the cover of pharmaceutical tote box or food supply container in a closed position during shipping and/or storage. As another example, tie 11 can be used to secure the door of a truck or a storage room in a closed position. As another example, tie 11 can be used to couple together two or more articles of commerce, such as shoes.

Tie 11 comprises a head 13 and an attached strap 15. Preferably, tie 11 is manufactured of a plastic material, such as nylon, and is formed as a single piece through conventional molding techniques. It should be noted that a barcode, serial number, or any other type of product identification would preferably be printed directly onto attached strap 15.

As seen most clearly in FIGS. 4–9, head 13 is generally rectangular in shape and comprises a bottom wall 17, a top wall 19, a first sidewall 21, a second sidewall 23, an outer end wall 25 and an inner end wall 26. Bottom wall 17, top wall 19, first sidewall 21, second sidewall 23, outer end wall 25 and inner end wall 26 together define an inner surface 27 for head 13 and an outer surface 28 for head 13. An opening 29 is formed into bottom wall 17 of head 13. As seen most clearly in FIGS. 5 and 8, opening 29 is generally square-shaped in lateral cross-section.

Figure 9:
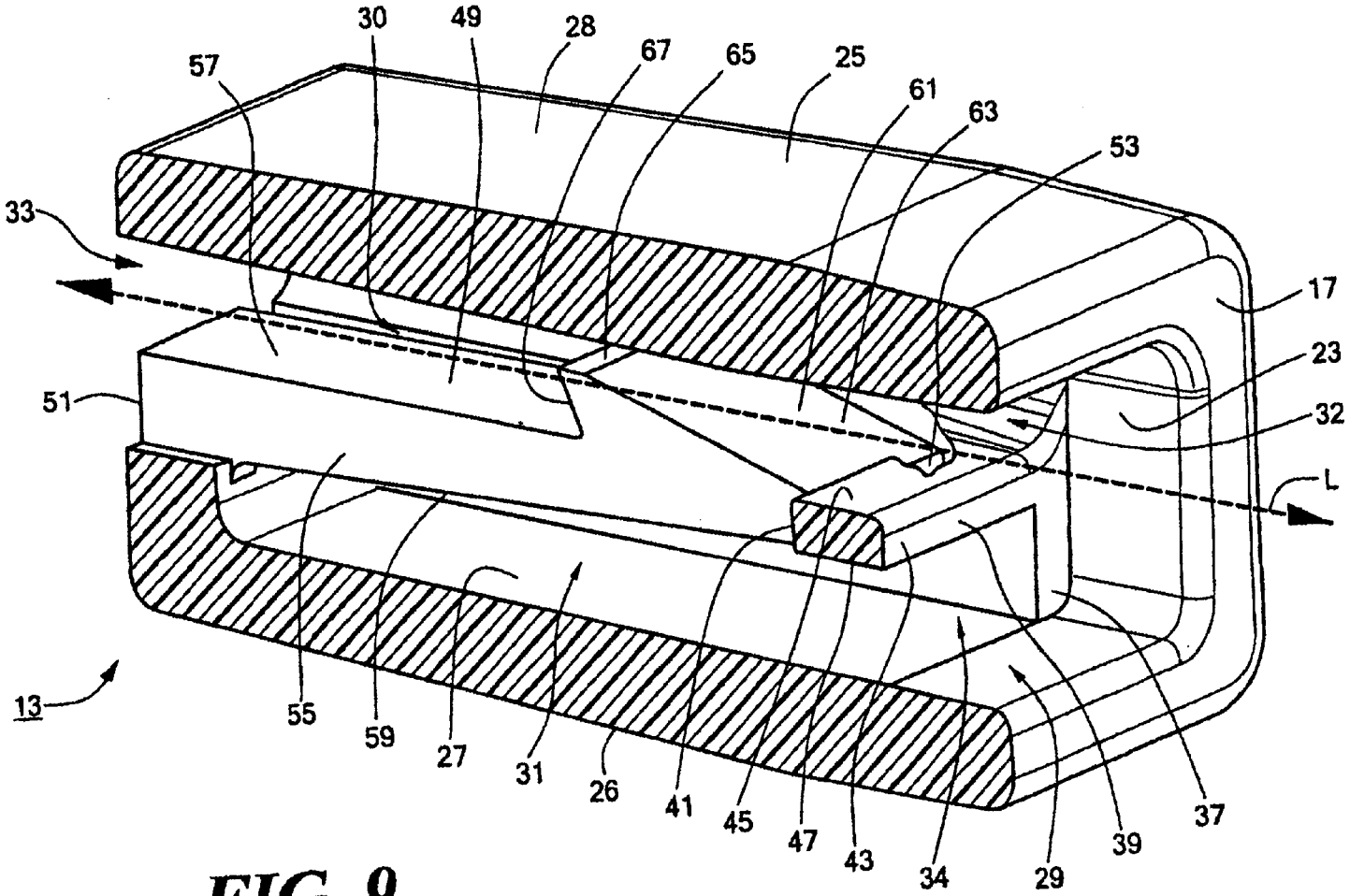
FIG. 9 is an enlarged, perspective, section view, broken away in part, of the head of the tie shown in FIG. 5, taken along lines 9—9.
Figure 10:
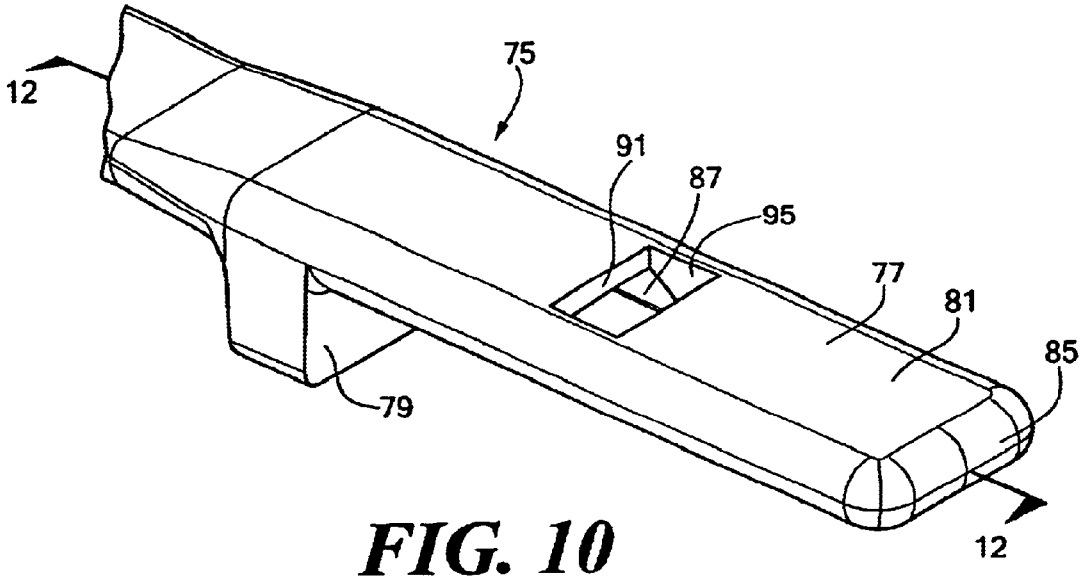
FIG. 10 is an enlarged, fragmentary, top perspective view of the tail of the tie shown in FIG. 1.
Figure 11:
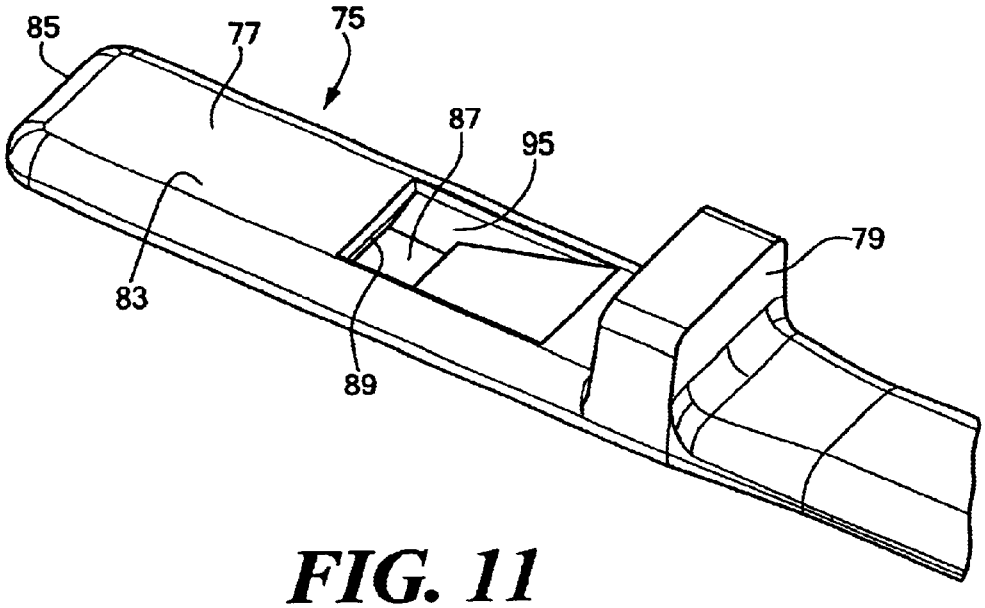
FIG. 11 is an enlarged, fragmentary, bottom perspective view of the tail of the tie shown in FIG. 3.
Figure 12:
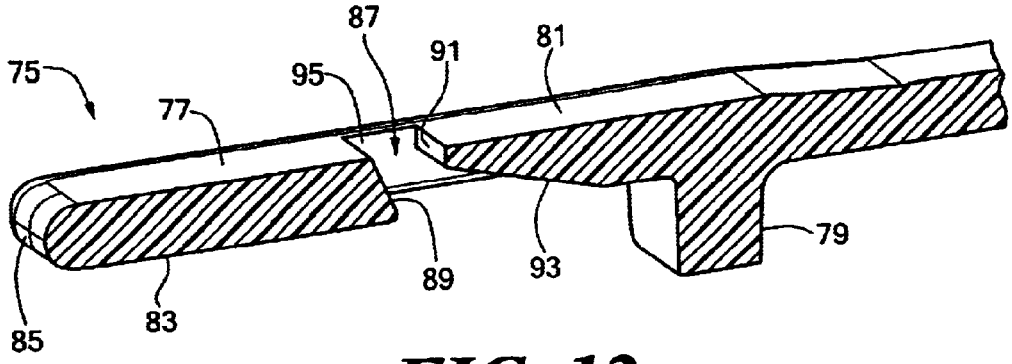
FIG. 12 is an enlarged, fragmentary, section view of the tail of the tie shown in FIG. 10, taken along lines 12—12.
Figure 13A:
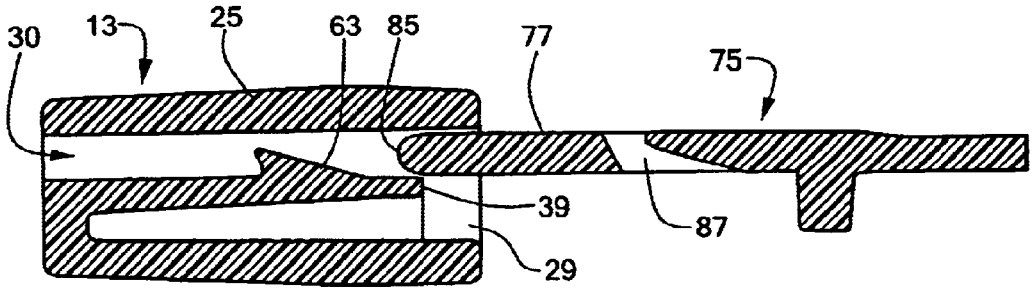
FIGS. 13(*a*)–(*f*) represent a series of fragmentary, section views of the tie shown in FIG. 1, taken along lines 13—13, as the anti-tampering device is inserted into the head.
Figure 13B:
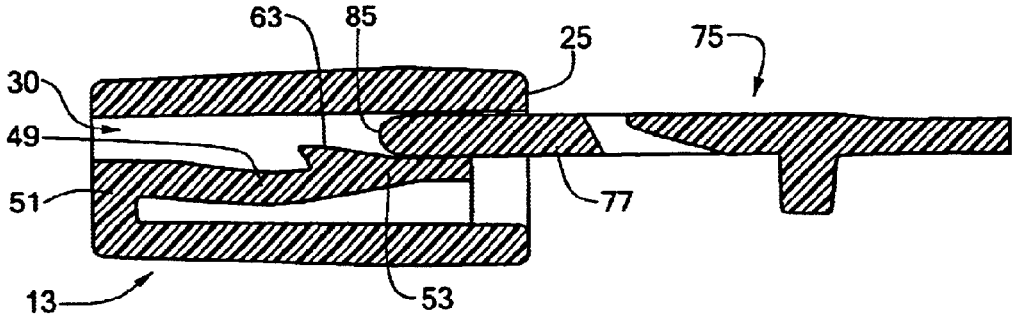
Figure 13C:
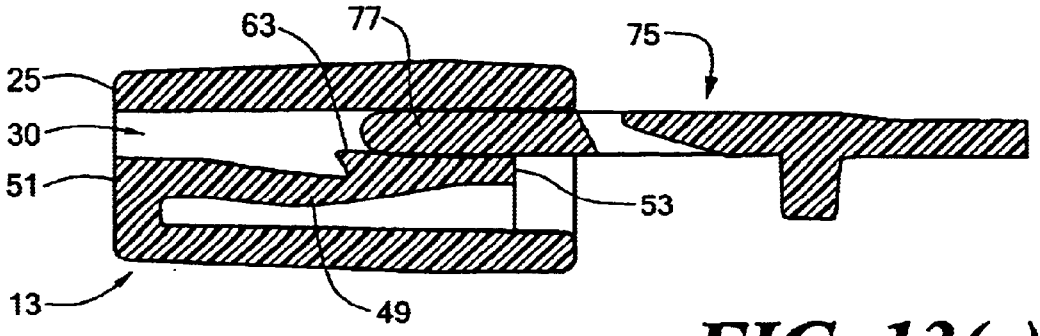
Figure 13D:
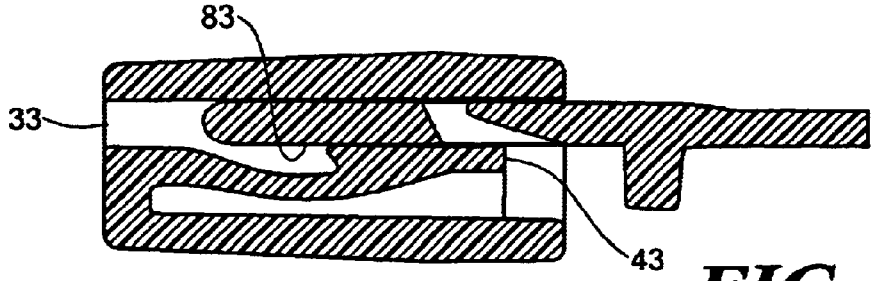
Figure 13E:
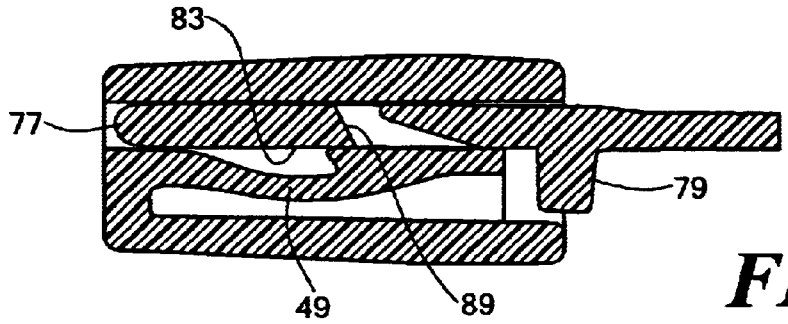
Figure 13F:
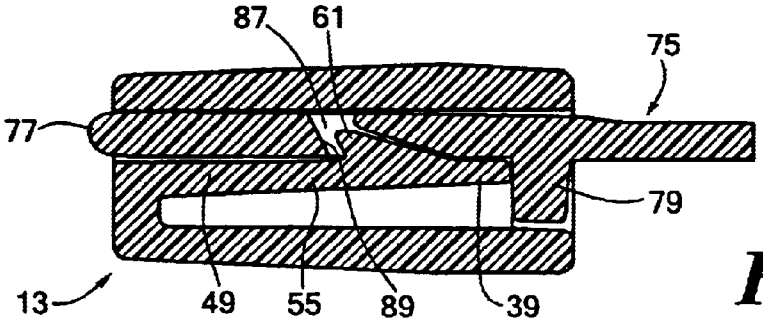

As seen most clearly in FIG. 9, head 13 is shaped to define an elongated, interior, strap accepting channel 30 and an elongated, interior blind cavity 31. Both strap accepting channel 30 and blind cavity 31 and are in communication with opening 29.

Strap accepting channel 30 extends longitudinally within head 13. Strap accepting channel 30 includes a longitudinal axis L, a strap entry end 32 and a strap exit end 33. As seen most clearly in FIGS. 8 and 9, strap entry end 32 is generally oval-shaped in lateral cross-section. Strap entry end 32 is spaced slightly in from bottom wall 17 and is in communication with opening 29. As seen most clearly in FIGS. 4, 6 and 9, strap exit end 33 of strap accepting channel 30 is generally oval-shaped in lateral cross-section and is formed in top wall 19. It should be noted that strap exit end 33 has a lateral cross-sectional area which is considerably small in size, thereby rendering tie 11 less susceptible to tampering, which is highly desirable.

Blind cavity 31 extends longitudinally within head 13. Blind cavity 31 includes an open end 34 and a pair of spaced apart, vertical slots 35. As seen most clearly in FIGS. 5, 8 and 9, open end 34 is generally rectangular in lateral cross-section. Open end 34 is spaced slightly in from bottom wall 17 and is in communication with opening 29. As seen most clearly in FIGS. 4 and 6, each vertical slot 35 is formed into top wall 19 and is generally rectangular in lateral cross-section.

Slots 35 are provided in top wall 19 of tie 11 to enable the interior of head 13 to be formed through conventional molding techniques. However, it should be noted that each slot 35 has a lateral cross-sectional area which is considerably small in size so as to render tie 11 less susceptible to tampering through slots 35, which is highly desirable. Specifically, each slot 35 has a width $W_1$ which is approximately 0.02 inches. As a result, only a device which has a thickness less than 0.02 inches could be inserted through slots 35. As can be appreciated, a device which has a thickness less than 0.02 inches would not have the structural integrity and strength that is required to tamper with a pawl disposed inside head 13.

Figure 8:
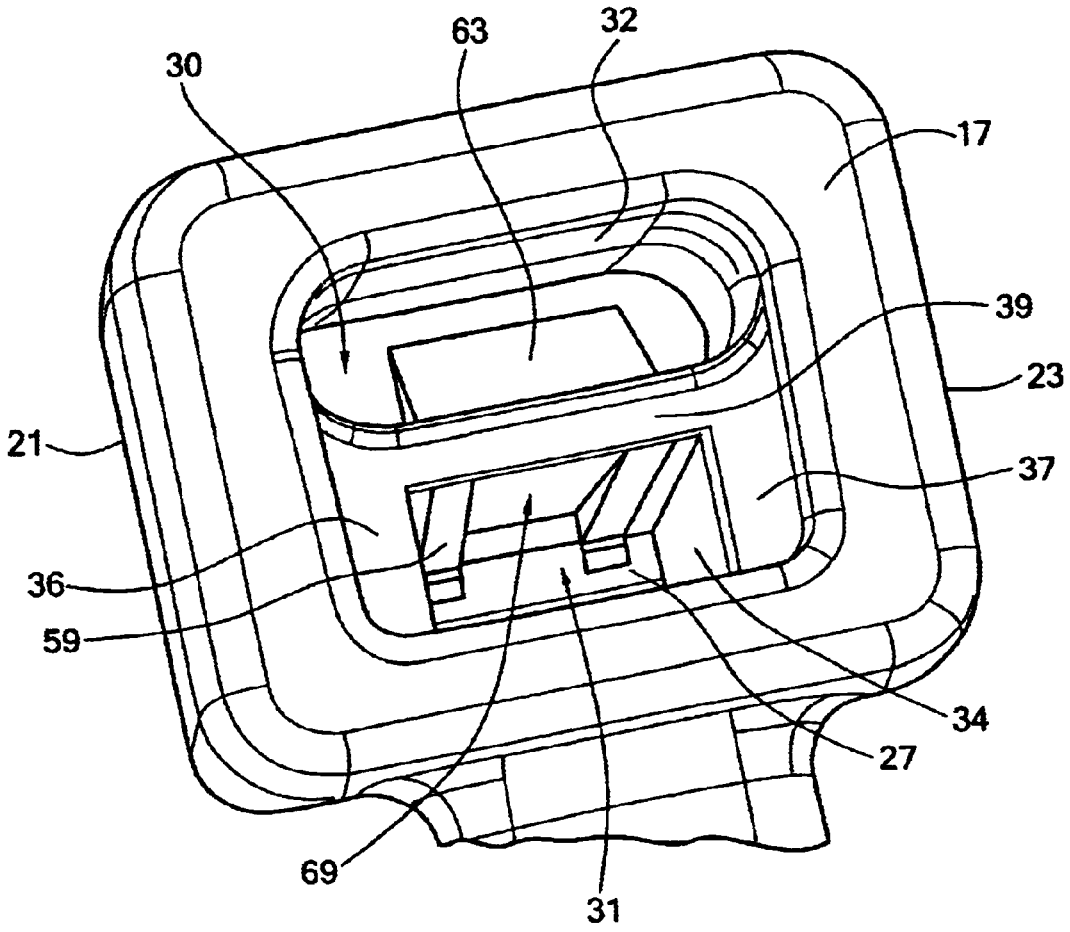
FIG. 8 is an enlarged, fragmentary, bottom perspective view of the head of the tie shown in FIG. 3.

Head 13 also comprises a first vertical support member 36 integrally formed onto inner surface 27 of first sidewall 21, a second vertical support member 37 integrally formed onto inner surface 27 of second sidewall 23, and a horizontal cross-member 39 integrally formed, at one end, onto first vertical support member 36 and integrally formed, at its other end, onto second vertical support member 37. In this manner, cross-member 39 extends horizontally from first sidewall 21 to second sidewall 23 and is disposed between strap entry end 32 and open end 34, as seen in FIGS. 8 and 9.

Vertical support members 36 and 37 provide structural integrity, stability and support for horizontal cross-member 39. However, it is to be understood that vertical support members 36 and 37 are not essential components of head 13 and, as a result, could be removed from head 13 without departing from the spirit of the present invention. Specifically, in the absence of vertical support members 36 and 37, horizontal cross-member 39 could be integrally formed, at one end, directly onto first sidewall 21 and integrally formed, at its other end, directly onto second sidewall 23 without departing from the spirit of the present invention.

Horizontal cross-member 39 is spaced slightly in from opening 29 formed in bottom wall 17. Horizontal cross-member 39 is rectangular in longitudinal cross-section, as seen most clearly in FIG. 9, and comprises an inner surface 41, an outer surface 43, a top surface 45 and a bottom surface 47.

Head 13 further comprises a locking member 49 which is disposed between and defines strap accepting channel 30 and blind cavity 31, as seen most clearly in FIG. 9. Locking member 49 projects through head 13 at an angle which is approximately in parallel with longitudinal axis L, outer end wall 25 and inner end wall 26.

Locking member 49 includes a first end 51 and a second end 53. As will be described further in detail below, first end 51 and second end 53 are fixed in place within head 13 and are incapable of displacement. By affixing first end 51 and second end 53 in place within head 13, tie 11 is provided with a plurality of notable advantages which will be enumerated in detail below.

First end 51 of locking member 49 is integrally formed onto inner surface 27 of top wall 19. Second end 53 is integrally formed onto inner surface 41 of horizontal cross-member 39. As such, first and second ends 51 and 53 are fixedly held in place within head 13.

As seen most clearly in FIG. 9, locking member 49 is shaped to include an elongated arm 55 which is generally rectangular in longitudinal and lateral cross-section. Elongated arm 55 includes a top surface 57 and a bottom surface 59. Locking member 49 is also shaped to include a ratchet tooth 61 which is integrally formed onto top surface 57 of elongated arm 55 so as to protrude towards outer end wall 25. Ratchet tooth 61 has an enlarged, rigid construction and includes an elongated, angled guiding surface, or ramp, 63, a flat, top surface 65 and an angled engagement surface, or shelf, 67. As will be described further in detail below, tooth 61 of locking member 49 is sized and shaped to engage strap 15 so as to secure tie 11 in a looped configuration.

As seen most clearly in FIG. 8, a recess 69 is formed into bottom surface 59 of elongated arm 55 along the length of locking member 49. Recess 69 has a lateral cross-sectional area which is generally rectangular and which gradually decreases, or tapers, from first end 51 to second end 53. As can be appreciated, recess 69 serves to significantly reduce the lateral cross-sectional area of elongated arm 55. As a result, recess 69 serves to increase the overall flexibility, or bendability, of elongated arm 69. As will be described further in detail below, locking member 49 is capable of flexing, or giving, about the approximate midpoint of elongated arm 55 so as to enable locking member 49 to selectively engage strap 15 when tie 11 is formed into a closed loop configuration.

As seen most clearly in FIGS. 1–3 and 10–12, strap 15 is an elongated flexible member which is generally uniform and rectangular in lateral cross-section. However, it is to be understood that strap 15 could be constructed in alternative sizes and shapes without departing from the spirit of the present invention.

Strap 15 comprises a first end 71 and a second end 73. First end 71 is integrally formed on head 13 so as to render tie 11 a unitary device.

Strap 15 also comprises an anti-tampering device 75 which is integrally formed onto second end 73 so as to render strap 15 a unitary device. As will be described further in detail below, anti-tampering device 75 can be inserted into head 13 so as to form tie 11 into a closed loop. Accordingly, it should be noted that anti-tampering device 75 serves a plurality of functions. Specifically, anti-tampering device 75 is adapted to be engaged by locking member 49 when tie 11 is formed into a closed loop, thereby preventing strap 15 from being backed out of head 13. In addition, anti-tampering device 75 is sized and shaped to substantially enclose opening 29 and strap exit end 33 when tie 11 is formed into a closed loop, thereby rendering locking member 49 of tie 11 unsusceptible to tampering. Furthermore, anti-tampering device 75 serves as a mechanism for limiting the minimum size of the closed loop which can be formed by tie 11.

Anti-tampering device 75 is an integral piece which comprises an elongated finger 77 and a projection 79.

Elongated finger 77 extends out from second end 73 of strap 15 in such a manner so that the longitudinal axis of elongated finger 77 is in parallel with the longitudinal axis of the remainder of strap 15. As seen most clearly in FIGS. 1–3, elongated finger 77 has a width and thickness which is slightly greater than the width and thickness of the remainder of strap 15. However, it is to be understood that strap 15 could alternatively be constructed so that elongated finger 77 has a width and thickness which is equal to the width and thickness of the remainder of strap 15 without departing from the spirit of the present invention.

Elongated finger 77 is in the form of an elongated, thin member which is generally rectangular in lateral cross-section. Finger 77 includes a flat top surface 81, a flat bottom surface 83 and a rounded free end 85.

Figure 14:
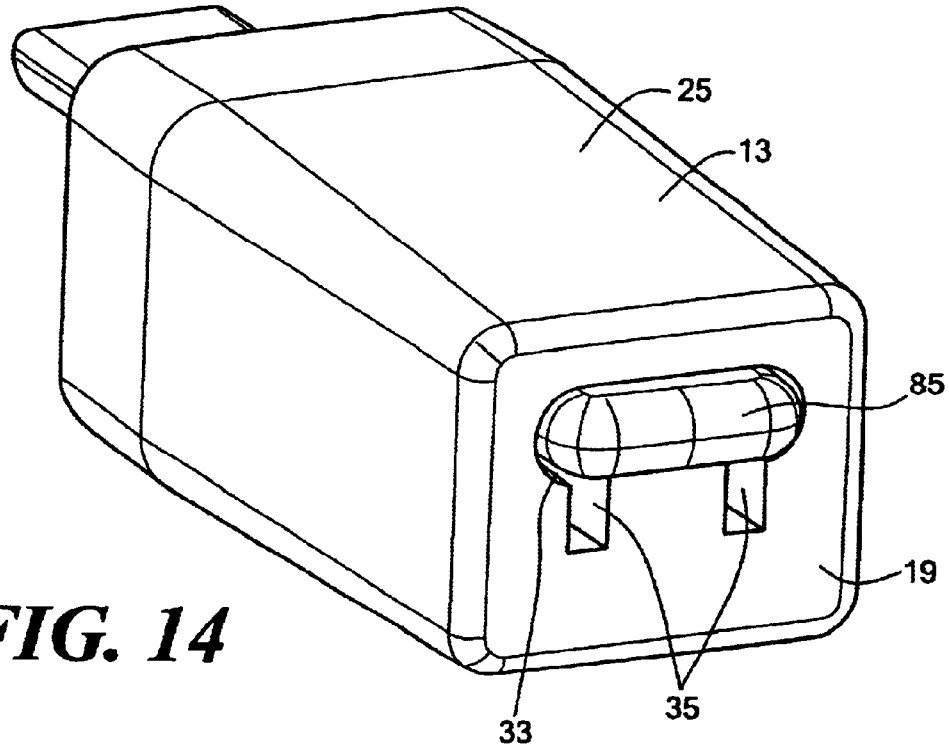
FIG. 14 is an enlarged, fragmentary, top perspective view of the tie shown in FIG. 1, the tie being shown with the tail inserted into the head.

It should be noted that rounded free end 85 is sized and shaped to substantially enclose exit end 33 of strap accepting channel 30 when tie 11 is formed into a closed loop, as seen most clearly in FIG. 14. As such, an unscrupulous person is incapable of tampering with locking member 49 through exit end 33, which is highly desirable.

Elongated finger 77 is shaped to define an opening 87 which is sized and shaped to receive locking member 49 when tie 11 is formed into a closed loop. Specifically, elongated finger 77 is shaped to include an angled engagement surface 89 which extends from top surface 81 to bottom surface 83, as seen most clearly in FIG. 12. Elongated finger 77 is also shaped to include a vertical surface 91 which extends orthogonally down from top surface 81 and an angled abutment surface 93 which extends at an angle from the free end of vertical surface 91 to bottom surface 83, as seen most clearly in FIG. 12. Elongated finger 77 is further shaped to include a pair of sidewalls 95 which are disposed in a spaced apart, parallel relationship. Together, engagement surface 89, vertical surface 91, abutment surface 93 and sidewalls 95 define opening 87, opening 87 having a longitudinal cross-sectional area at top surface 81 which is considerably less than its longitudinal cross-sectional area at bottom surface 83.

Projection 79 is in the form an enlarged stop which is generally rectangular in longitudinal and lateral cross-section. Projection 79 is integrally formed onto and projects orthogonally away from bottom surface 83 of finger 77.

Figure 15:
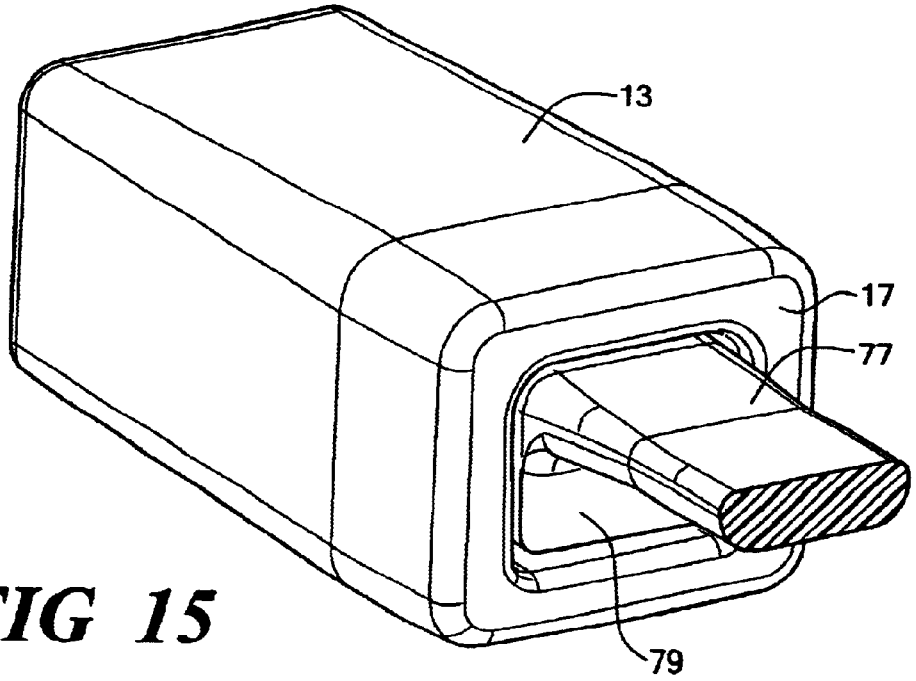
FIG. 15 is an enlarged, fragmentary, bottom perspective view of the tie shown in FIG. 1, the tie being shown with the tail inserted into the head.

It should be noted that anti-tampering device 75 (more particularly, the portion of anti-tampering device 75 from top surface 81 of finger 77 to the free end of projection 79) is sized and shaped to be fittingly disposed within opening 29 (thereby enclosing strap entry end 32 of strap accepting channel 30 and open end 34 of blind cavity 31) when tie 11 is formed into a closed loop, as seen clearly in FIG. 15. As such, an unscrupulous person is incapable of tampering with locking member 49 through either strap entry end 32 or open end 34, which is highly desirable.

In use, tie 11 can be formed into a closed loop in the following manner. Specifically, tie 11 is bent, or configured, in such a manner so that anti-tampering device 75 is directed through opening 29 and into strap entry end 32 of strap accepting channel 30.

Referring now to FIG. 13(*a*), anti-tampering device 75 is inserted through opening 29 and into strap entry end 32 of strap accepting channel 30 with rounded free end 85 of finger 77 disposed between outer end wall 25 and horizontal cross-member 39. Disposed in this manner, tie 11 forms a closed loop.

Referring now to FIG. 13(*b*), as anti-tampering device 75 is further inserted into head 13, rounded free end 85 of finger 77 contacts elongated ramp 63 of locking member 49. As can be appreciated, the insertion force of anti-tampering device 75 causes finger 77 to impart a significant downward force onto elongated ramp 63 of locking member 49. As a result of the downward force imparted onto elongated ramp 63, locking member 49 begins to bow, or flex, in a concave manner at its approximate midpoint between first end 51 and second end 53 in order to create the necessary spacing between locking member 49 and outer end wall 25 so that finger 77 is capable of penetrating through strap accepting channel 30. It should be noted that locking member 49 is able to bow, or flex, in a concave manner due to the placement of blind cavity 31.

Referring now to FIG. 13(*c*), as anti-tampering device 75 is further inserted into head 13, finger 77 continues to slide along elongated ramp 63 of locking member 49 which, in turn, causes locking member 49 to continue to bow, or give, in a concave manner about the approximate midpoint between locking member 49 and outer end wall 25. It should be noted that, because first and second ends 51 and 53 of locking member 49 are fixed in place within head 13 and are incapable of displacement, locking member 49 has a stiffness, or rigidity, which is relatively high in comparison to the stiffness of locking tangs in conventional ties. In order to overcome the relatively high level of stiffness of locking member 49, locking member 49 is provided with a guiding surface 63 which has a long, tapered, ramp-like configuration. Due to the particular configuration of guiding surface 63, the user is able to overcome the high level of stiffness of locking member 49 in such a manner so as to enable locking member 49 to bow in a concave manner about its approximate midpoint between first end 51 and second end 53 without requiring the user to apply a considerable insertion force, which is highly desirable.

Referring now to FIGS. 13(*d*) and 13(*e*), as anti-tampering device 75 is further inserted into head 13, flat bottom surface 83 of elongated finger 77 continues to contact and slide along ramp 63 of locking member 49.

Referring now to FIG. 13(*f*), further advancement of anti-tampering device 75 eventually causes projection 79 to abut against outer surface 43 of horizontal cross-member 39, thereby precluding further forward advancement of anti-tampering device 75. Simultaneously, as projection 79 abuts against outer surface 43 of horizontal cross-member 39, opening 87 in anti-tampering device 75 is positioned directly above ratchet tooth 61 of locking member 49. Because bottom surface 83 of elongated finger 77 no longer imparts a downward force onto ramp 63, locking member 49 resiliently returns to its original configuration, with elongated arm 55 returning to its initial straight configuration. As elongated arm 55 straightens, ratchet tooth 61 is urged upward into opening 87, thereby lockably securing anti-tampering device 75 within head 13.

Accordingly, upon the application of a rearward withdrawal force on strap 15, engagement surface 89 in elongated finger 77 would abut against shelf 67 of tooth 61 so as to preclude removal of strap 15 from head 13, which is highly desirable. As can be appreciated, engagement surface 89 and shelf 67 are both specifically designed to have matching angular surfaces. The particular angles of engagement surface 89 and shelf 67 causes surface 89 to engage finger 77 upon the application of a rearward withdrawal force on strap 15, thereby significantly increasing the amount of force required to withdraw strap 15 from head 13, which is highly desirable.

It should be noted that, with anti-tampering device 75 fully inserted into head 13, strap 15 is sized and shaped so that projection 79 and finger 77 are fittingly disposed within opening 29 formed in bottom wall 17, as seen most clearly in FIGS. 13(*f*) and 15. As a result, projection 79 and finger 77 together serve to substantially enclose strap entry end 32 of strap accepting channel 30 and open end 34 of blind cavity 31. In addition, because horizontal cross-member 39 is spaced adequately in from bottom wall 17, projection 79 is able to fit snugly within opening 29 rather than align flush against bottom wall 17 of head 13. Accordingly, an unscrupulous person is precluded from tampering with locking member 49 through opening 29, which is highly desirable.

It should also be noted that, with anti-tampering device 75 fully inserted into head 13, the particular size and shape of rounded free end 85 of finger 77 serves to substantially enclose exit end 33 of strap accepting channel 30, as seen most clearly in FIGS. 13(*f*) and 14. Accordingly, an unscrupulous person is precluded from tampering with locking member 49 through exit end 33, which is highly desirable.

It should further be noted that, although anti-tampering device 75 does not enclose slots 35, the tampering of locking member 49 through slots 35 is considerably difficult. Specifically, as noted above, only a tampering device which has a thickness less than 0.02 inches could be inserted through slots 35. As can be appreciated, a device which has a thickness less than 0.02 inches would not have the structural integrity and strength that is required to tamper with locking member 49.

Because both first end 51 and second end 53 are fixed in place within head 13 and are incapable of displacement, locking member 49 provides tie 11 with a number of significant advantages over conventional ties which comprise a locking tang which is fixed in place at only one end.

As a first advantage, because both first end 51 and second end 53 are fixed in place within head 13 and are incapable of displacement, locking member 49 is only capable of flexion, or bending, at the approximate midpoint between first end 51 and second end 53. This is significant in that the area of flexion for locking member 49 is spaced adequately in from both strap entry end 32 and strap exit end 33 and is therefore less accessible for tampering, which is highly desirable.

As a second advantage, because both first end 51 and second end 53 are fixed in place within head 13 and are incapable of displacement, locking member 49 has a stiffness, or rigidity, which is considerably greater than the stiffness of locking tangs of conventional ties. Due to its relatively high level of stiffness, locking member 49 would require a greater tampering force to disengage ratchet tooth 61 from opening 87 in finger 77, thereby rendering tie 11 less susceptible to tampering than prior art ties, which is highly desirable.

As a third advantage, because both first end 51 and second end 53 are fixed in place within head 13 and are incapable of displacement, tie 11 is able to withstand a considerably greater withdrawal force than conventional ties, thereby rendering tie 11 more secure than conventional ties, which is highly desirable.

As a fourth advantage, because both first end 51 and second end 53 are fixed in place within head 13 and are incapable of displacement, head 13 of tie 11 is capable of being constructed in such a manner so that strap entry end 32 and strap exit end 33 of strap accepting channel 30 are greatly reduced in size, thereby rendering tie 11 less susceptible to tampering, which is highly desirable.

The embodiment of the present invention described above is intended to be merely exemplary and those skilled in the art shall be able to make numerous variations and modifications to it without departing from the spirit of the present invention. As an example, tie 11 could be alternatively constructed in such a manner so that first end 51 of locking member 49 is fixed in place and second end 53 of locking member 49 is capable of displacement without departing from the spirit of the present invention. All such variations and modifications are intended to be within the scope of the present invention as defined in the appended claims.

What is claimed is:

1. A tie comprising:

(a) a head shaped to include an elongated strap accepting channel, the strap accepting channel having a longitudinal axis, a strap entry end and a strap exit end, said head comprising a locking member, the locking member comprising a first end and a second end, the first and second ends of the locking member being held fixed in place within said head, the locking member comprising a flexible arm and a rigid tooth formed on the flexible arm, the rigid tooth being disposed to project into the strap accepting channel; and (b) a strap having a first end and a second end, the first end being formed onto said head, said strap being sized and shaped to be inserted into the strap accepting channel so said tie forms a closed loop, said strap being adapted to be engaged by the rigid tooth on said locking member when said tie is formed into a closed loop.

2. The tie as claimed in claim 1 wherein the flexible arm of said locking member is capable of flexion but is incapable of pivotal displacement.

3. The tie as claimed in claim 1 wherein said strap is sized and shaped to substantially enclose the strap entry end and the strap exit end of the strap accepting channel when said tie is formed into a closed loop.

4. The tie as claimed in claim 3 wherein said head comprises a bottom wall, a top wall, a first sidewall, a second sidewall, an outer end wall and an inner end wall.

5. The tie as claimed in claim 1 wherein the elongated arm of said locking member comprises a top surface and a bottom surface, one of said top and bottom surfaces being shaped to include a recess along at least a portion of its length.

6. A tie comprising:

(a) a head comprising a bottom wall, a top wall, a first sidewall, a second sidewall, an outer end wall and an inner end wall, said head being shaped to include an elongated strap accepting channel, the strap accepting channel having a longitudinal axis, a strap entry end and a strap exit end, wherein an opening is formed into the bottom wall of said head and the strap exit end is formed into the top wall of said head, said opening being in communication with the strap entry end, said head comprising a locking member which is disposed to project into the strap accepting channel, the locking member comprising a first end and a second end, the first and second ends of the locking member being fixed in place within said head; and (b) a strap having a first end and a second end, the first end being formed onto said head, said strap being sized and shaped to be inserted into the strap accepting channel so said tie forms a closed loop, said strap being adapted to be engaged by said locking member when said tie is formed into a closed loop, said strap being sized and shaped to substantially enclose the strap entry end and the strap exit end of the strap accepting channel when said tie is formed into a closed loop.

7. The tie as claimed in claim 6 wherein said head comprises a cross-member which extends horizontally through said head from the first sidewall to the second sidewall at an angle which is approximately perpendicular to the longitudinal axis of the strap accepting channel.

8. The tie as claimed in claim 7 wherein said head comprises a first support member formed onto the first sidewall and a second support member formed onto the second sidewall.

9. The tie as claimed in claim 8 wherein said cross-member is connected, at one end, to the first support member and is connected, at its other end, to the second support member.

10. The tie as claimed in claim 7 wherein said cross-member is spaced slightly in from the strap entry end of said head.

11. The tie as claimed in claim 7 wherein the second end of the locking member is formed onto the cross-member.

12. The tie as claimed in claim 11 wherein the first end of the locking member is formed onto the top wall.

13. The tie as claimed in claim 12 wherein the locking member extends in parallel with the longitudinal axis of the strap accepting channel.

14. The tie as claimed in claim 6 wherein said strap includes an anti-tampering device which is adapted to be engaged by said locking member when said tie is formed into a closed loop.

15. The tie as claimed in claim 14 wherein said anti-tampering device is sized and shaped to substantially enclose the opening formed in the bottom wall of said head and the strap exit end formed in the top wall of said head when said tie is formed into a closed loop.

16. The tie as claimed in claim 15 wherein the anti-tampering device is formed onto the second end of said strap.

17. The tie as claimed in claim 15 wherein said anti-tampering device comprises, (a) a finger sized and shaped to substantially enclose the exit end of the strap accepting channel when said tie is formed into a closed loop, and (b) a projection formed onto said finger, said projection and said finger together being sized and shaped to substantially enclose the opening formed in the bottom wall of said head when said tie is formed into a closed loop.

18. The tie as claimed in claim 17 wherein said finger is shaped to include an opening which is sized and shaped to receive the locking member when said tie is formed into a closed loop.

19. The tie as claimed in claim 18 wherein said finger includes a top surface and a bottom surface, said projection extending orthogonally out from the bottom surface of said finger.

* * * * *